United States Patent [19]

Sampson

[11] 4,187,773

[45] Feb. 12, 1980

[54] BUNDLE TYING MACHINE

[76] Inventor: Jacob Sampson, 6138 N. Clark St., Chicago, Ill. 60660

[21] Appl. No.: 934,632

[22] Filed: Aug. 17, 1978

[51] Int. Cl.[2] ..... B65B 13/22

[52] U.S. Cl. ..... 100/4; 100/7; 100/19 R; 198/654

[58] Field of Search ..... 100/4, 7, 17, 18, 19 R; 198/654

[56] References Cited

U.S. PATENT DOCUMENTS

| | | | |
|---|---|---|---|
| 1,454,545 | 5/1923 | La Bombard | 100/19 R |
| 1,464,332 | 8/1923 | Pease | 100/7 X |
| 1,597,697 | 8/1926 | Saxton | 100/18 X |
| 1,606,290 | 11/1926 | Bunn | 100/7 |
| 2,346,786 | 4/1944 | Radeck | 100/4 |
| 2,374,900 | 5/1945 | Saxton | 100/17 X |
| 2,407,313 | 9/1946 | Malhiot | 198/654 |
| 2,662,468 | 12/1953 | Shenigo | 100/4 X |
| 2,867,166 | 1/1959 | Saxton et al. | 100/7 X |
| 2,898,847 | 8/1959 | Bunn | 100/4 |
| 3,068,780 | 12/1962 | Gates et al. | 100/17 X |
| 3,085,501 | 4/1963 | Wimmer | 100/7 X |
| 3,189,163 | 6/1965 | Ayres | 100/4 X |
| 3,264,976 | 8/1966 | Ayres | 100/7 X |
| 3,288,271 | 11/1966 | Burford | 198/654 |
| 3,330,205 | 7/1967 | Smith | 100/7 X |
| 3,386,370 | 6/1968 | Brown | 100/7 X |

*Primary Examiner*—Billy J. Wilhite

*Attorney, Agent, or Firm*—McDougall, Hersh & Scott

[57] ABSTRACT

A bundle tying machine which operates with a conveyor chain that carries longitudinally spaced pairs of bundle holding plates through a curvilinear loading section and unloading section and a straight bundle tying section with means mounting the plates for relative movement and with means responsive to the presence of bundles between the plates for freeing the bundle tying mechanism to effect tying of the bundle in the tying section and including means for varying the tension on the twine at various stages during operation of the machine, and multiple needles for simultaneously tying the bundle with a plurality of twines in a single path.

30 Claims, 16 Drawing Figures

L
T
U
10
12
14
16
20
22
24
26
28
29
30
32
40
42
44
46
50
51
52
60
62
110
118
120
122
124
126
128
130
134
136
140

BUNDLE TYING MACHINE

This invention relates to a bundle tying machine, and more particularly to a conveyorized machine which operates automatically, sequentially to convey bundles to be tied from a loading station to a tying station, where the bundles are firmly embraced while being tied to produce a tightly packaged bundle, and then to convey the tied bundle to an unloading station for delivery of the tightly tied bundle.

An important feature of this invention resides in the reliance substantially entirely on mechanical means for control and for carrying out the various operations of the machine, whereby reliability of operation is greatly increased and repair is simplified for this operates to improve the output of the machine while at the same time enabling the machine to be operated without the need for highly skilled labor.

It is an object of this invention to produce a bundle tying machine of the type described which relies primarily on mechanical operation and control; which can be operated on a continuous basis without the need for continuous supervision; which is capable of considerable flexibility in operation from the standpoint of the size and character of the elements to be tied into bundles; which produces a tightly tied bundle; which is simple in construction and easy in operation, thereby to constitute a relatively low cost machine which can be operated without the need for skilled labor; in which the loading of the machine with the material to be tied can be easily effected in the loading area, and in which the loaded material is automatically compacted into a compact bundle to be tied upon transport into the tying area, thereby to enable loading mechanically or automatically, and which dwells at the loading station to provide ample time for either automatic, mechanical or manual loading of the machine, and which occupies a minimum amount of space for enabling easy alignment with equipment generating the material to be tied for transfer of the material manually or automatically to the bundle tying machine.

These and other objects and advantages of the invention will hereinafter appear and, for purposes of illustration, but not of limitation, an embodiment of the invention is shown in the drawings in which.

A bundle tying machine of this invention is suitable for use to produce tied bundles of mail, packages, labels, printed matter, envelopes, boxes, stacked plates and the like, sheet material of various sizes, shapes and dimensions, and in which such bundles are tied with string, cord, twine, wires, tapes and the like to produce bundles which can be handled for storage, shipment or for transfer from one station to another, and in which the tied bundles can be stacked for palletizing, packing or storage in a stable and compact assembly.

Figure 1:
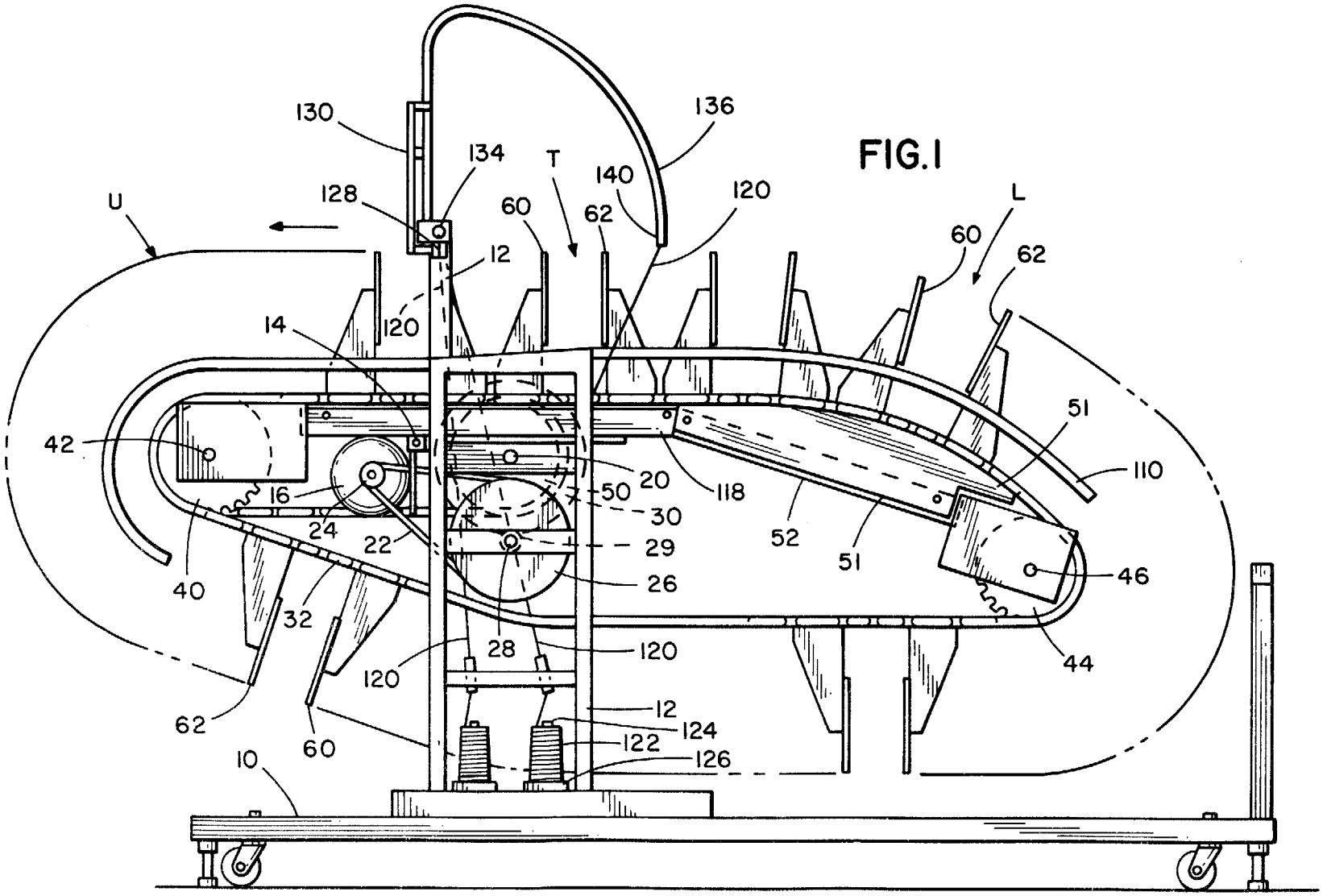
FIG. 1 is a side elevational view showing the general layout of the machine.

For a brief description of the loading of the machine, reference is made to FIG. 1 which shows a main frame 10 provided with a pair of upright frame members 12. The machine is powered by an electric motor 16 mounted on a bracket 14 which is fixed to the upper end portion of the upright frame members 12.

The operation of the various elements and controls is taken off of a main shaft 20 which extends crosswise between the laterally spaced apart upright frame members 12 having supporting bearings in which the ends of the main shaft 20 are journaled for rotational movement.

Rotational movement is transmitted from the electric motor 16 to the main shaft 20 through a V-belt 22 which extends from a pulley 24 on the motor shaft to a pulley 26 and from the pulley 26 through gears 29 on the pulley shaft 28 in meshing engagement with the main shaft drive gear 30.

Figure 2:
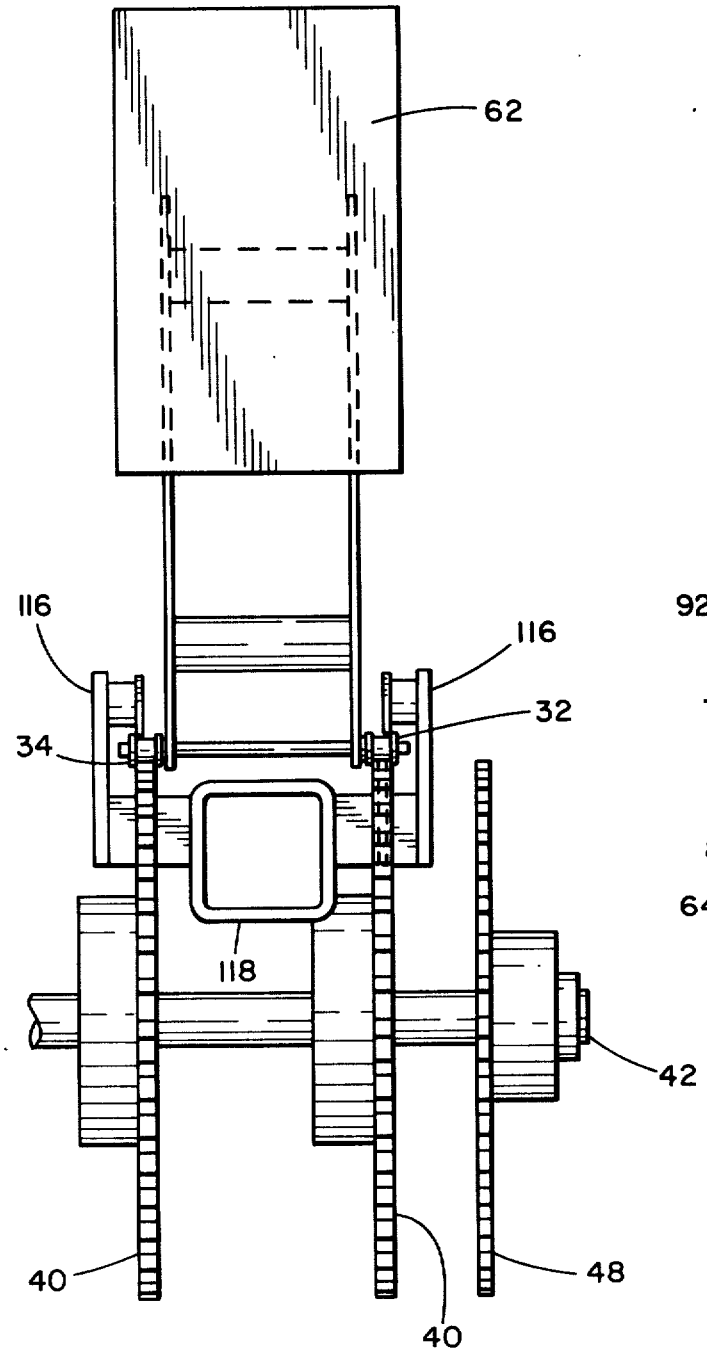
FIG. 2 is an end elevational view of the machine shown in FIG. 1, on an enlarged scale.
Figure 3:
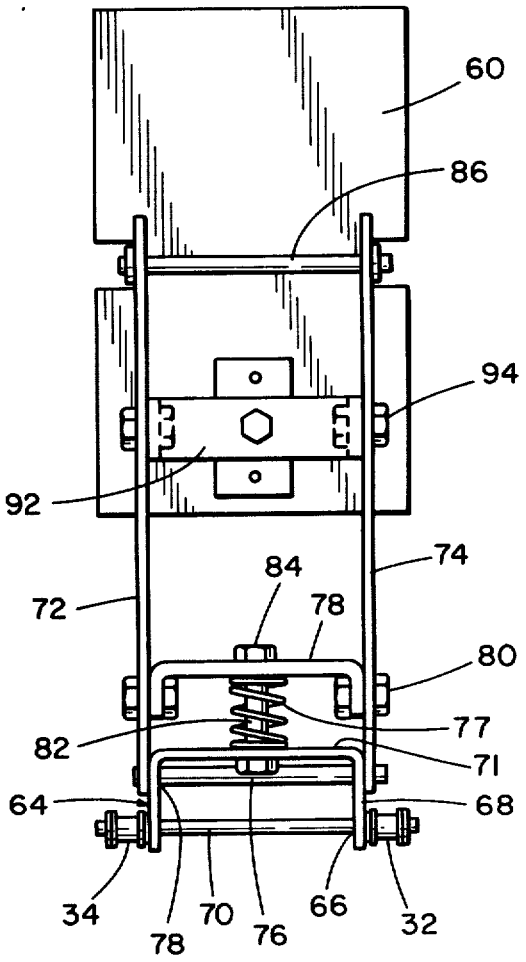
FIG. 3 is a front elevational view of the swing plate assembly.
Figure 4:
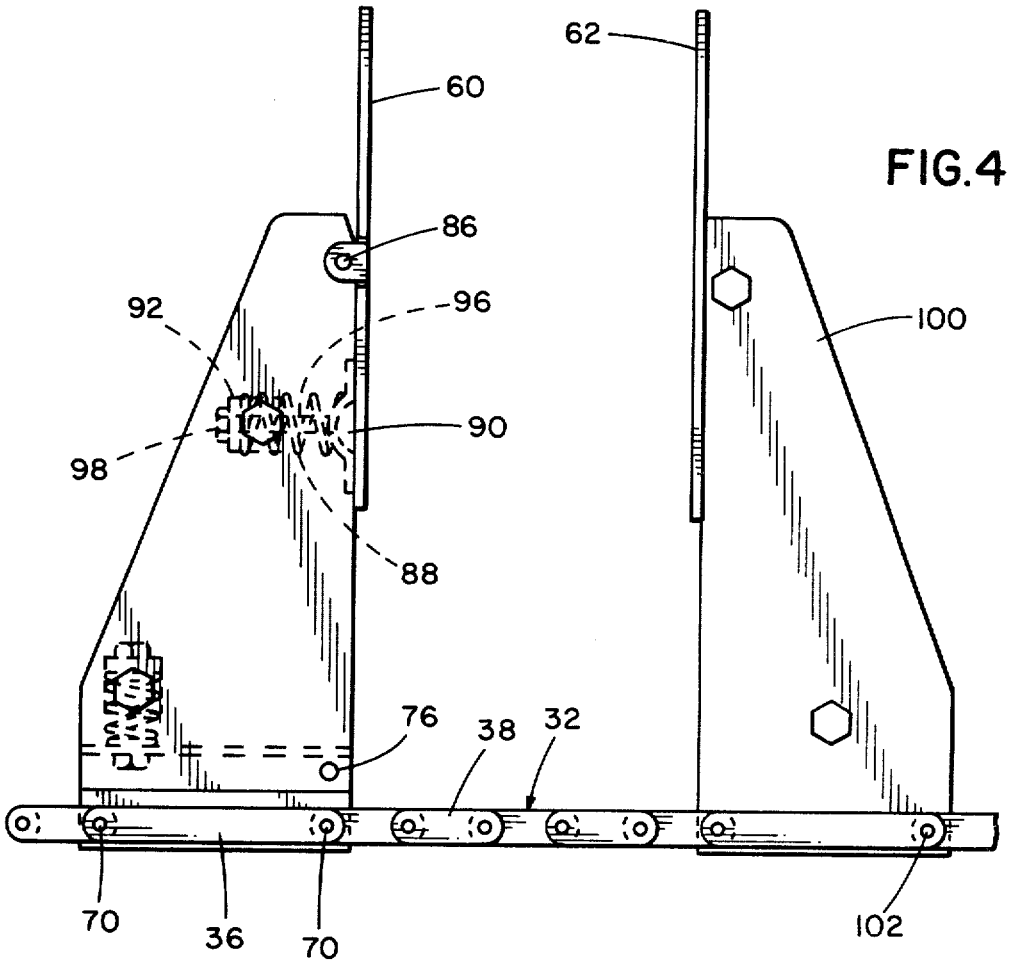
FIG. 4 is a side elevational view of the swing plate assembly shown in FIG. 3.

The conveyor of the conveyorized bundle tying machine of this invention comprises a pair of laterally spaced apart endless chains 32 and 34 formed of interconnected chain links including longitudinally spaced apart plate supporting links 36 and interconnecting links 38 pivotally connected one to another with the plate supporting links 36 dimensioned to be of greater length (about 3") as compared with the shorter (about 1") interconnecting links 38. (FIGS. 2, 3 & 4)

Figures 5, 6, 9:
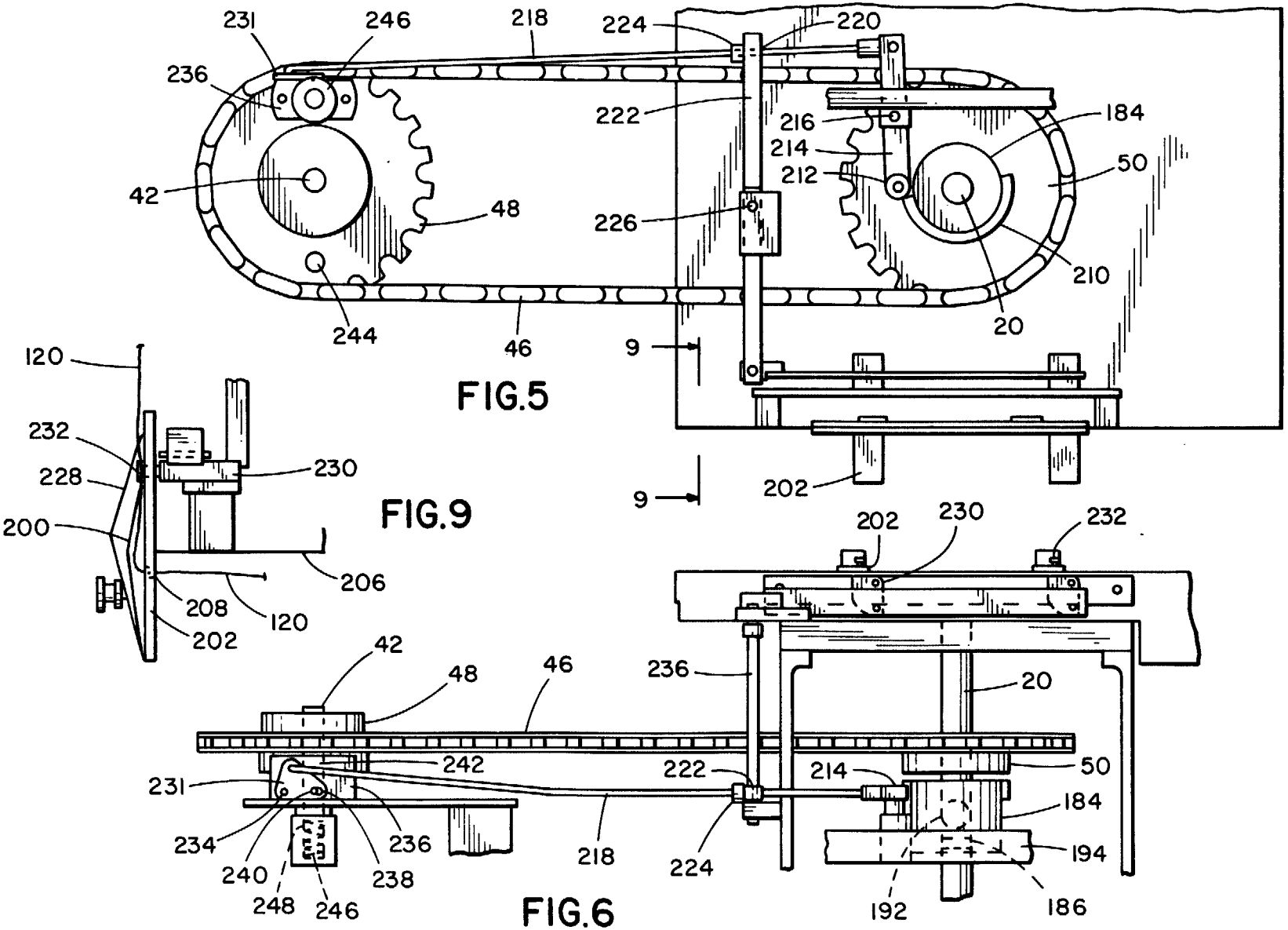
FIG. 5 is a side view of a portion of the machine showing the means for controlling tension on the twine and for locking the conveyor against movement.
FIG. 6 is a top plan view of the portion of the machine shown in FIG. 5.
FIG. 9 is a detailed elevational view of the string tying means.

The conveyor chains are trained about driving sprockets 40 mounted in corresponding laterally spaced apart relation on a driven shaft 42 and about idler sprockets 44 mounted on an idler shaft 46 in which the sprockets are journaled at their ends on the frame members for rotational movement. The shaft 42 is driven from the main shaft 20 via a chain 46 interconnecting a sprocket 48 on the driven shaft 42 with a sprocket 50 on the main shaft 20 for intermittent movement in a manner hereinafter to be described. (FIGS. 1, 5 & 6)

The conveyor assembly is mounted on a tubular frame 52 with guides for the conveyor chains 32 and 34 for movement along their upper run through a loading station L, a bundle tying station T and an unloading station U where the tied bundles are released for delivery from the machine. (FIG. 1)

An important concept of this invention resides in the construction of the loading section whereby the conveyor chains travel along curvilinear rails 51 fixed to extend upwardly from the tubular frame member 52 during their rise from the idler sprocket 44 to the bundle tying section T, and in which the conveyor chains support longitudinally spaced apart pairs of brackets 64 which mount facing plates 60 and 62 spaced one from the other in the pairs by an amount corresponding to about the thickness of the bundles to be tied when the plates are in substantially parallel relation, but in which the plates 60 and 62 extend angularly relative to each other to provide for an increased space relation between their upper ends as the chain travels along the curvilinear path in the loading section. For this purpose, the path through which the chains travel through the loading section is formed to concave shape having a radius ranging from twenty-four to ninety six inches and preferably forty to sixty inches, depending somewhat on the size of the machine and the length of travel in the loading section as well as the thickness of the bundles to be positioned between the plates in the pairs. (FIGS. 2 & 3)

Another of the important concepts of this invention resides in the means for mounting the plates in each pair so that at least one of the plates 60 or 62 is movable relative to the other in the pair to provide flexibility for accommodation of bundles which may vary in thickness or shape, or bundles formed of packages that may vary in thickness or shape, particularly when such differences occur in the vertical direction.

Detailed illustrations are made in FIGS. 3 and 4 of the drawings of a pair of plates in which, in the preferred arrangement, one of the plates, namely, the rearward plate 62 of the pair is stationarily secured to the chain link while the forward plate 60 of the pair is supported on a chain link in the manner to permit swinging and pivotal movement relation to the stationary plate. In the illustrated modification, the mounting of the plate 60 for relative movement comprises a U-shaped bracket 64 dimensioned to have a length corresponding to the length of the link 36 of the conveyor chain. With crosswise aligned openings 66 in the depending flanged portion 68 of the bracket through which pins 70 connecting the links extend so that the U-shaped bracket 64 is more or less rigidly supported on the link with the bale portion 71 spaced upwardly from the link chain. (FIG. 3)

A pair of laterally spaced apart swing bucket plates 72 and 74 are pivoted for rocking movement about a horizontally disposed pivot pin 76 which extends through crosswise aligned openings 78 in the rear portion of the flanges 68 of the bracket 64 and the corresponding rearward portions of the swing bucket plates 72 and 74 in their overlapping lower end portions.

Means are provided resiliently to urge the swing bucket plates 72 and 74 to rock about their pivot pin 76 in the clockwise direction built with means for limiting the extent of such swinging movement. Such means is illustrated as comprising a compression spring 77 which is confined between the bale portion 71 of the supporting bracket and a crossbar 78 which extends crosswise between the laterally spaced swing bucket plates 72 and 74 and is secured thereto at its respective ends by nut and bolt means 80. The compression spring 77 is concentrically arranged about a limiting bolt 82 which extends through vertically aligned openings in the bale portion 71 of the bracket 64 and the crossbar 78 spaced above the bracket with nut members 84 threadably engaging threaded end portions of the through extending bolt thereby to limit the relative swinging movement in the clockwise direction while resiliently resisting swinging movement in the counterclockwise direction. (FIG. 3)

The plate 60 is supported by the swing bucket plates 72 and 74 for rocking movement relative thereto about a horizontal axis as by means of a hinged plate pin 86 which extends crosswise between aligned openings in the crosswise spaced swing bucket plates adjacent their upper end portion and through ears 89 extending perpendicularly from the lateral edges of the plate 60 intermediate its upper and lower ends. Means are provided resiliently to urge the plate 60 to rock about its pivot in the counter clockwise direction but with means to limit such movement. Such means are illustrated as including a compression spring 88 having one end centered on a button 90 on the back side of the plate 60 below the pivot 86, with the other end of the spring 88 bearing against a crossbar 92 secured at its lateral ends, as by means of nut and bolt means 94, to the crosswise aligned portions of the swing bucket plates 72 and 74. The compression spring 88 is held in place by a bolt 96 which extends centrally through the coil spring and through an opening in the crossbar 92, with a threaded end portion extending through the opening for threaded engagement by a nut member 98 which operates as a means for limiting the amount of displacement by the spring. (FIGS. 3 & 4)

It will be seen from the foregoing that the plate 60 can rock for a limited distance relative to its swing bucket plate support, and that the latter is also free to rock for a limited distance about its supporting bracket 64, thereby to provide flexibility for accommodations, as previously described, while also providing factors for resilient engagement of the bundle between the plates during transport from the loading section to the tying section. (FIG. 3)

The facing plate 62 can be similarly resiliently supported but it is most often sufficient resiliently to mount but one of the plates in the pair. Thus, in the preferred practice of the invention, the other plate 62 is rigidly secured and may form a part of the vertically disposed bucket plates 100 which are supported directly from the link 36 by pins 102 which extend crosswise between the links through aligned openings in the lower end portions of the stationary bucket plates 100. (FIG. 4)

Fixed to the frame are a pair of laterally spaced apart, rigid platforms 110 which extend continuously from the beginning of the loading section through the tying section to the unloading section at a level above the rails on which the conveyor chain rides but below the lower ends of the hinge plates 60 and 62. The platforms are in parallel relation with a spacing therebetween greater than the width of the material being bundled and preferably spaced for a distance to position the platforms immediately alongside the outer edges of swing bucket plates 60 and 62. (FIG. 1)

Figure 16:
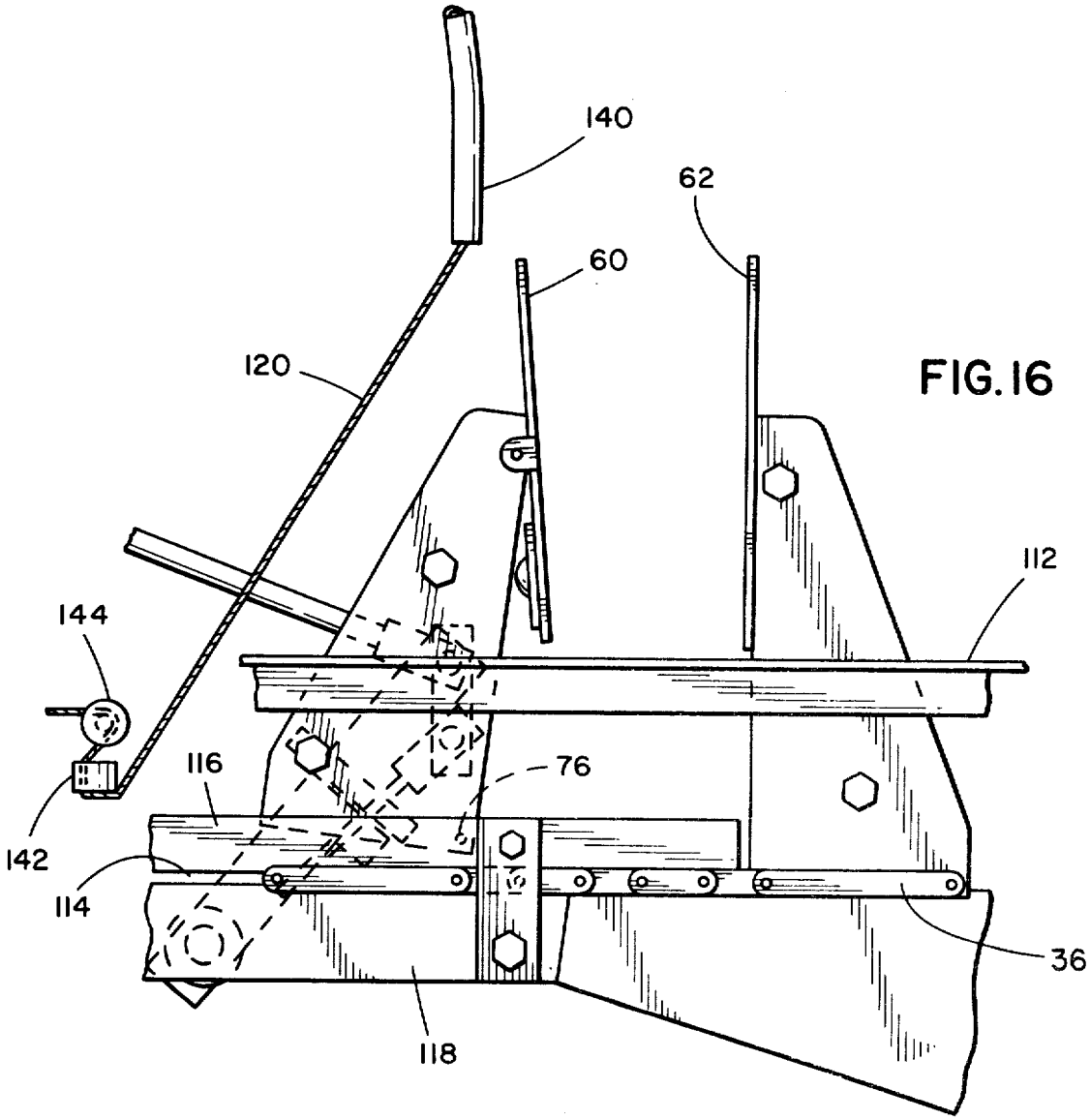
FIG. 16 is a side elevational view of the elements immediately in advance of tripping the means for dictating the presence of a bundle.

The platforms have a horizontally disposed surface portion 112 on which the material to be tied into bundles rests as it is displaced by the pairs of hinged plates 60 and 62 through the loading, tying and unloading sections of the machine. The platforms extend in substantially parallel relation with the conveyor chain rail whereby, in response to the sharp concave curvature at the discharge end, the hinge plates spread farther apart to release the tied bundle. (FIG. 16).

During passage through the tying section, means are provided to prevent flexing of the conveyor chain 32 and 34 and for causing the chain to travel in a substantially straight horizontal path through the tying section whereby the plates 60 and 62 in the pair are relatively rigidly maintained in substantially parallel upright relation. For this purpose, the chains 32 and 34 are confined slideably to travel through continuous slots 114 formed between upper and lower conveyor chain guiderails 116 and 118 spaced to correspond with linking portions of the conveyor chain for confinement thereof and therebetween. (FIG. 7).

Figure 12:
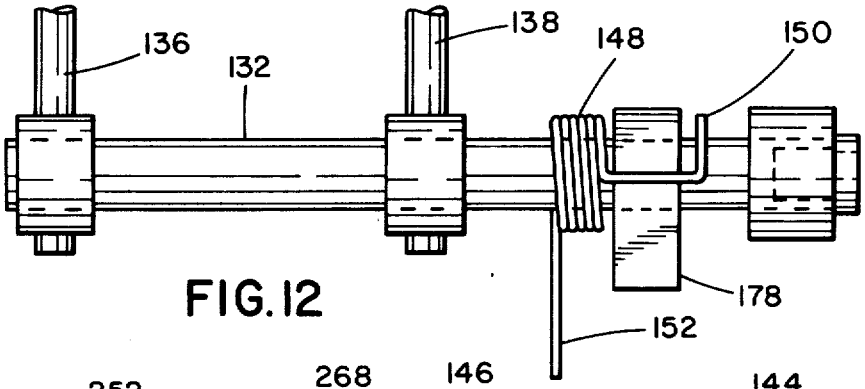
FIG. 12 is an elevational view of the needle arm shaft and elements connected therewith.
Figure 13:
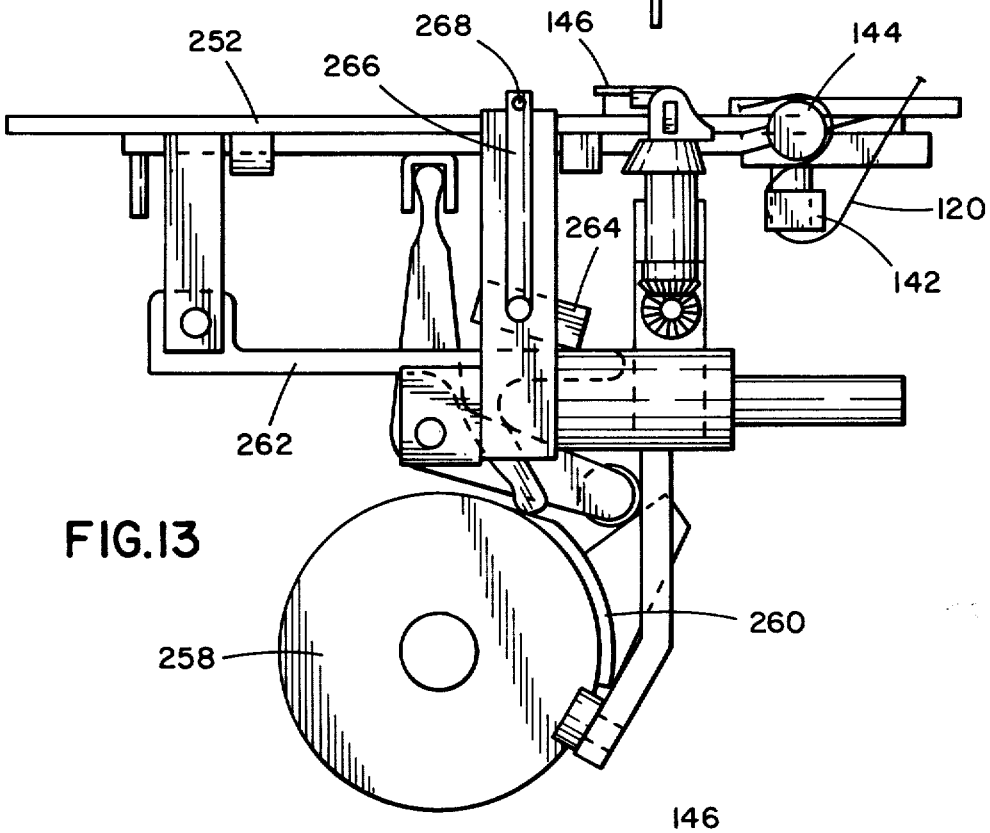
FIG. 13 is an elevational view of the stripper and operator mechanism.

The twine 120 for tying the bundles is fed from two spools 122 telescoped upon spindles 124 extending upwardly from mounting plates 126 fixed to the lower main frame 10. The twine 120 extends upwardly from the spindles to a pair of rollers 128 for guiding the twines and for maintaining constant tension. The rollers are mounted for free rotational movement on the end of a depending bracket arm 130 in axial alignment with a hollow twine arm shaft 132 mounted for rotational movement about a pivot 134 secured to an upright frame member 12. The twine extends from the rollers 128 through the shaft 132 to laterally spaced apart curvilinear hollow needles 136 and 138 fixed to the shaft for rocking movement therewith between raised and lowered positions, with the hollow needles communicating at their inlet ends with the bore through the shaft to enable one of the twines to enter each of the shafts and extend through the needle to the exit end 140. The twine extends continuously from the exit end 140 down across a rearward portion of the bundle tying section, alongside the platforms 110 and in the path of the lateral edge portions of the bundles to be tied, when such bundles are carried between the plates 60 and 62. The free end of the twine is strung around a retainer bar 142 and then is anchored by the twine holder 144 fixed to a tying table mounted between the frame members 12. (FIGS. 1, 12 & 13).

Figure 7:
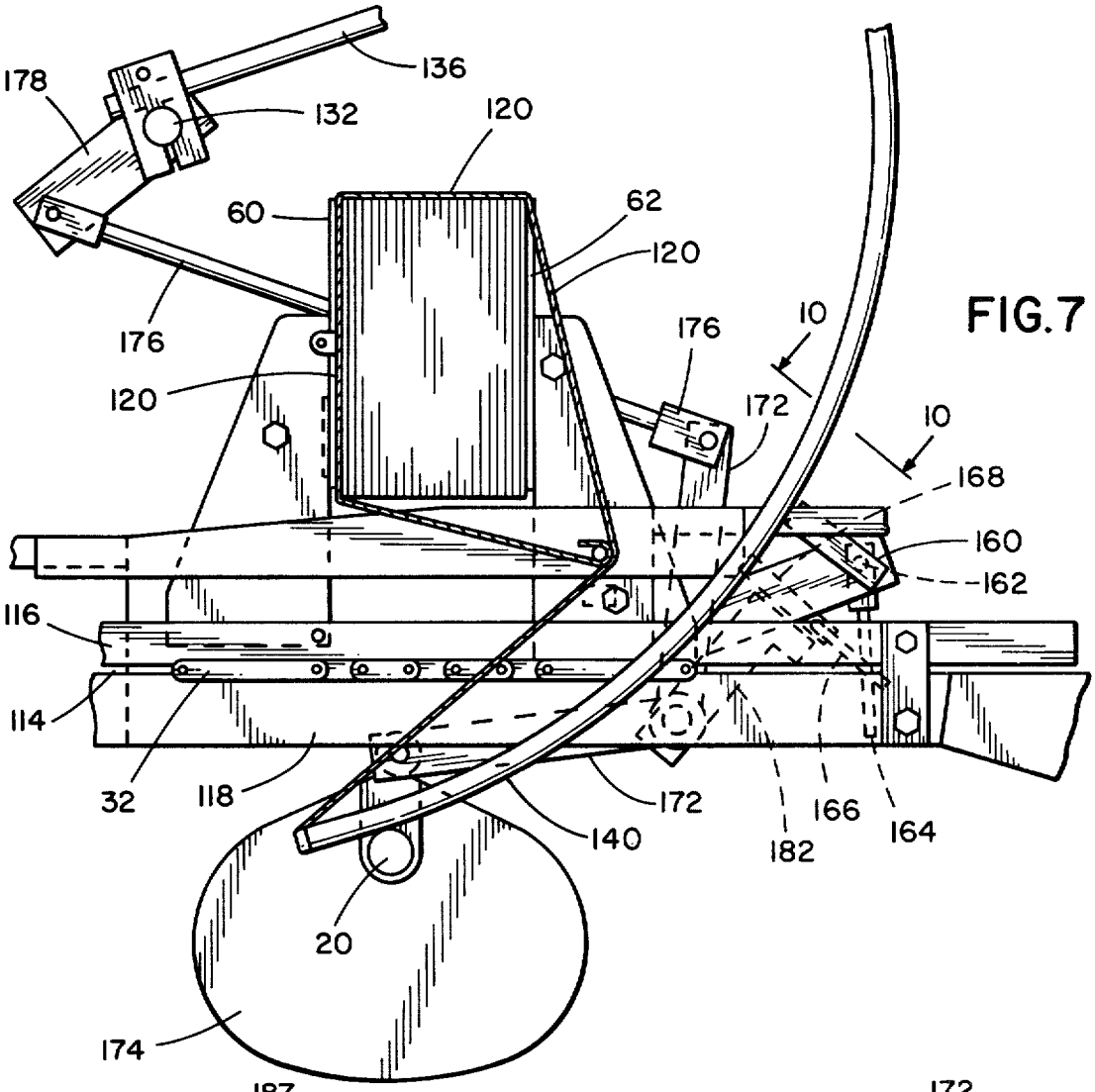
FIG. 7 is an elevational view of the portion of the machine which illustates the elements in the bundle tying position.

The twine arm shaft 132 is mounted between frame members for rocking movement between needle raised position, shown in FIG. 1, to needle lowered position shown in FIG. 7. Means are provided resiliently to urge the twine arm shaft toward lowered position. In the illustrated modification, such means comprise a coil spring 148 concentrically mounted above a portion of the shaft 132 with one end 150 anchored onto the shaft while the other end 152 is anchored to the stationary base plate on the machine. (FIG. 12)

When in raised position, the exit end 140 of the needles is spaced a short distance above the upper edges of the pairs of plates 60 and 62 so that the plates can pass under the needles to bring the bundle into engagement with a portion of the twine extending from the ends of the needles to the twine holders. As the plates with the bundles to be tied pass through the line drawn by the twine, the twine is engaged by the lateral leading edges of the bundle and, upon continued displacement of the bundles along the bundle tying section, and by reason of the ends of the twine being anchored, the bundle deflects the twine from its path to extend from the twine holder 144 forwardly across the bottom side of the bundle, up the front side of the bundle and rearwardly over the top of the needle. When the bundle clears the ends of the needle, means are operated to release the twine arm shaft 132 and needles 136 and 138 to be rocked by spring 148 about the pivot from raised to lowered position, as shown in FIG. 7, with the exit ends 140 of the needle at a level below the engaged bundle and forwardly of the rearward end portion thereof. This wraps the twine about the rearward side of the bundle and brings the twine into the vicinity of the end of the twine engaged by the holder where the tying mechanism can take over to knot the adjacent portions of the twine. (FIGS. 7 & 12)

Apparatus for tying and cutting is disclosed in the Saxon U.S. Pat. No. 2,374,900 entitled "Bundle Tying Machine", in the Bunn U.S. Pat. No. 2,898,847 entitled "Tying Machine" and in U.S. Pat. No. 1,606,290. The tying and cutting mechanism is of the type described in the aforementioned patents except for the stripper for stripping the twine from the beak of the tying mechanism.

Release of the shaft 132 for carrying out the described tying operation is controlled by an indicator lever 160 pivoted on pin 161 fixed to the frame for rocking movement between normal vertical position and operated position. When in vertical position, the indicator level 160 extends upwardly into the path of a lateral edge of the bundle when a bundle is present to be tied. The bundle trips the indicator for rocking movement from the raised to operated position.

Figure 10:
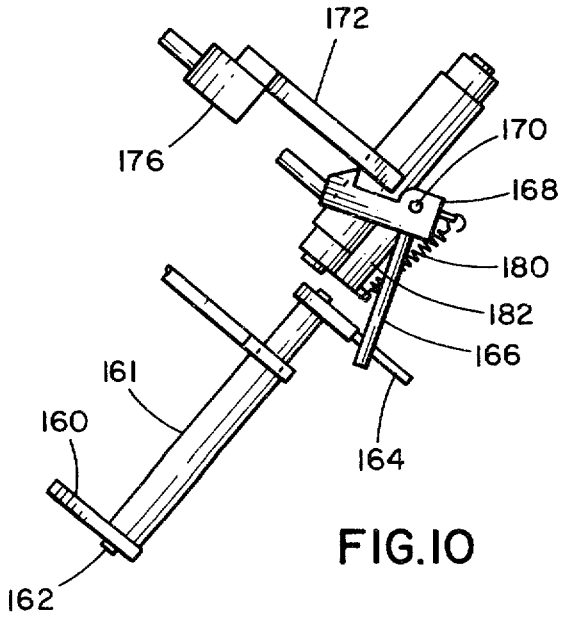
FIG. 10 shows a portion of the machine taken along the line 10—10 of FIG. 7.

The indicator lever 160 is fixed to a crosswise extending shaft 162 for conjoint rotational movement. An arm 164 which extends from an axially spaced portion of the shaft 162 rocks with the shaft in the direction to engage a rod 166 fastened to a latch 168 which is rocked about its pivot 170 to release an L-shaped cam follower arm 172 to follow the cam 174 on the main shaft 20. (FIGS. 7 & 10)

The cam follower arm 172 is connected by tie rod 176 and link 178 to the needle shaft 132. The cam 174 is contoured to control the movement of the needles from raised to lowered position responsive to the resilient force from the coil spring 148 and for actuating the needle shaft 132 for returning the needles from lowered to raised position in opposition to the coil spring.

While the needles are in lowered position, the knot tying and cutoff mechanisms operate to effect tying of the bundle. When the tying operation has been completed, the cam 174 enters the return cycle for retracting the needles from the lowered to raised positions. As the needles return to raised position, the twine 120 is wrapped about the string retainer 142 in preparation for the next tying cycle. Means are provided resiliently to urge the latch member 168 towards normal latching position. Such means is illustrated in the drawings by tension spring 180 anchored at one end to a portion of the latch member 168 offset from its pivot, while the other end is fixed to a mounting 182 on the frame 12. (FIGS. 7, 10 & 12)

In the event that no bundle is present between the plates 60–62, the indicator retractor remains in normal raised position to the end that the described tying operations are by-passed.

Figure 11:
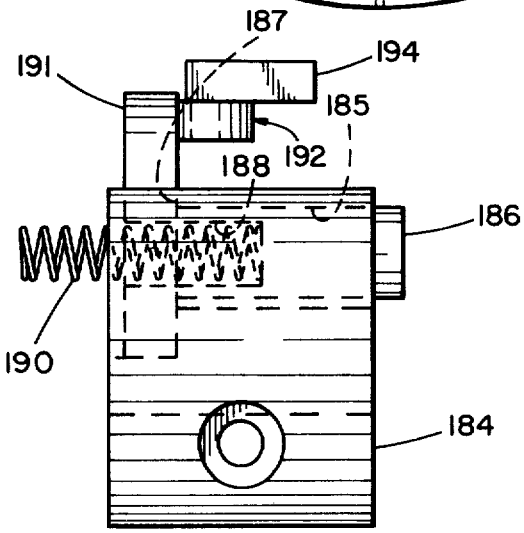
FIG. 11 is an elevational view of the driving clutch.
Figure 15:
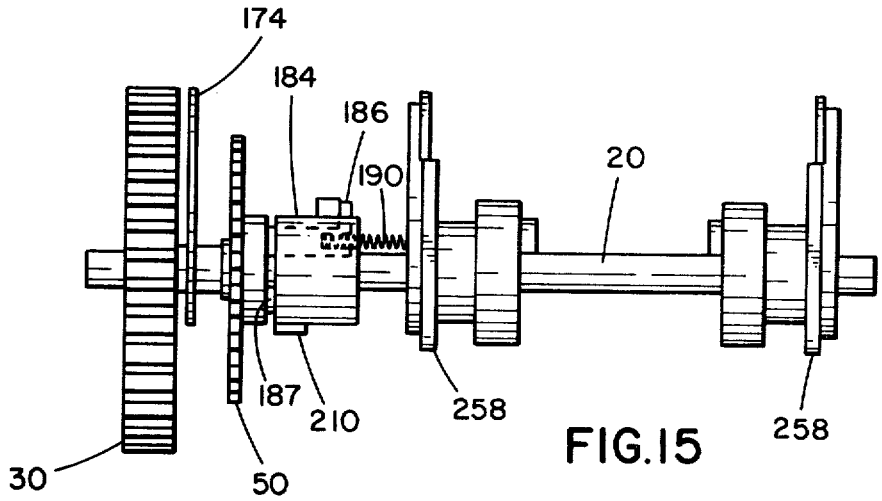
FIG. 15 is an elevational view of the main drive shaft and elements mounted thereon.

Means are provided for stopping the conveyor each time that a pair of plates 60–62 reach a predetermined position in the tying section, as when the plate 60 is about in crosswise alignment with the axis of the tying head mechanism. Such means comprises a clutch 184 mounted for rotational movement with the main shaft 20. The clutch has an axial cavity 185 in which a plunger 186 is slideably received for axial displacement between extended and retracted positions of adjustment. The drive sprocket 50, which is mounted on the shaft 20 alongside clutch 184, is freely rotatable on the shaft 20 and is provided with recesses 187 in the wall facing the clutch, in crosswise alignment with the plunger, to enable the plunger to project laterally from the clutch and become seated within the recess when in extended position for interconnection between the clutch and sprocket for conjoint movement. The plunger 186 is formed with a central cavity 188 which extends axially inwardly from the rearward end for receipt of a compression spring 190 which operates resiliently to urge the plunger towards extended position into engagement with the sprocket 50. (FIGS. 11 & 15)

Means are provided for retraction of the plunger 186 from extended position to disengage the clutch from the sprocket 50 when the plates 60-62 reach the predetermined tying position to the end that the conveyor comes to rest. For this purpose, a portion of the plunger 186 extends as an abutment 191 in the path of a roller 192 mounted on a bar 194 fixed to the frame. Upon engagement, the plunger 186 is displaced from extended to retracted position whereby the sprocket becomes disengaged from the clutch. (FIG. 11)

One or more equidistantly spaced recesses 187 can be provided in the face of the sprocket 50 for receipt of the plunger when in crosswise alignment. The number of recesses 187 will depend upon the length of dwell desired in the conveyor for completing the tying operation. When the plunger is unseated from a recess in response to the movement of the conveyor to bring the roller into engagement with the abutment 191, the end of the plunger thereafter becomes free to bear against the side of the sprocket as the clutch continues to turn relative to the sprocket until the plunger comes into endwise alignment with the next recess for entry in response to the resilient force from the compression spring. In the illustrated modification, the sprocket 50 is provided with two recesses 187 spaced 180° apart. This permits rotation of the clutch and main shaft 20 through an angle of 180° before the plunger 186 comes into crosswise alignment with the next recess for reengagement of the clutch and sprocket to operate the conveyor chains. Thus the conveyor is caused to dwell for a predetermined period of time calculated for completion of the tying operation and cam 174 is entered into its return cycle. (FIG. 15)

Figure 8:
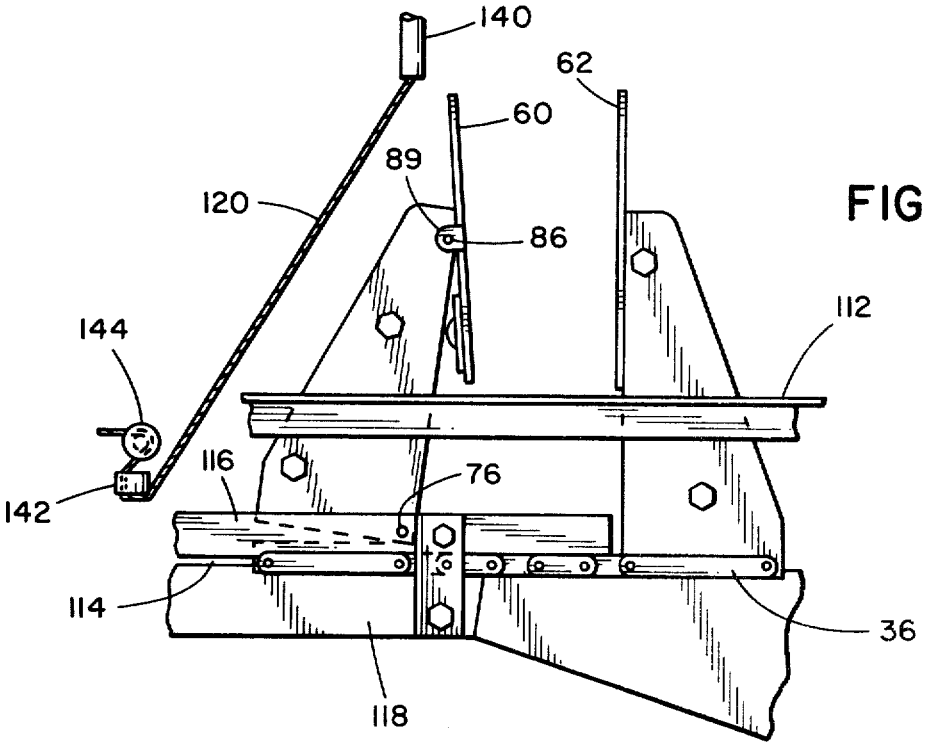
FIG. 8 is a side elevational view of the machine showing the relative position of the elements immediately prior to the bundle tying position.

During movement of the conveyor to carry the bundle into the twine for preliminary wrapping of the twine about the bundle, as from the position shown in FIG. 8 to the position shown in FIG. 7, it is desirable to have minimum tension on the twine for supply under slight tension. While the needles rock from raised position to lowered position, minimum tension on the twine is maintained by low tension leaf springs 200 (FIG. 9) mounted on a spring holder 202 which is fixed to the cover 206 of the machine. From the spool, the twine passes through opening 208 in the spring holder 202 and beneath the free end of the leaf spring 200, as it proceeds to the needles with minimum tension.

When the needles reach lowered position, it is desirable to increase the tension on the twine to a maximum tension in order to have the twines tightly embrace the bundle during the subsequent knotting and cutoff operations. This is achieved by means of a cam 210 provided on the periphery of the clutch 184 which rotates with the shaft 20 in the counter clockwise direction. The cam surface is engaged by a follower, in the form of a roller 212, mounted for rotational movement on the end of the arm 214. Arm 214 is pivoted intermediate its ends on pivot pin 216 fixed to the frame member 12. (FIG. 5)

An elongate rod 218 is pivotally secured at one end to a portion of the arm 214 on the opposite side of the pivot 216. Rod 218 extends through an opening 220 in an arm 222 and is provided with a fixed collar 224 on the through extending portion to enable the rod 218 to move freely in the direction towards the arm 222 for release of the arm for rocking movement about its pivot pin 226 engaging an intermediate portion of the arm 222, while the collar engages the rod to rock the rod in the opposite direction about its pivot when the rod 218 is withdrawn in response to movement of the follower 212 up onto the cam surface 210. FIG. 5 shows the relative positions when the needles have arrived at their lowered position of adjustment. Until such time, the follower 212 has been riding on the cam surface 210 whereby the arm is drawn about its pivot to deactivate the high pressure twine leaf spring 228 so that only the low tension leaf spring 200 operatively engages the twine. As shown in FIGS. 5 & 6, the opposite end portion of the arm 222 engages a pawl 230 having a button 232 which extends through the plate 202 into engagement with the end portion of the high tension leaf spring. 228 to lift the spring off the twine so that the twine is engaged only by leaf spring 200 to impart minimum tension. As the needles reach lowered position, the follower 212 clears the cam surface 210 to reverse the movements of the lever 214, rod 218 and arm 222, whereby the pawl 230 retracts to release the high tension leaf spring 228 for engagement with the twine to maximize tension on the twine during movement. (FIGS. 5, 6 & 9)

While the bundle is being tied and the sprocket 50 is disengaged from the clutch 184, as previously described, it is desirable positively to lock the conveyor against movement. This is accomplished by utilizing the rod 218 having a portion which extends beyond the arm 222 into engagement with a drive locking mechanism shown in FIGS. 5 and 6. For this purpose, there is provided a triangularly shaped lever 231 pivoted at an intermediate corner portion on a pivot pin 234 anchored to a table block 236. The end of the rod 218 is pivotally connected to a portion of the lever 231 offset in one direction from the pivot 234, while another portion of the lever, offset from the pivot in another direction, is provided with an elongate slot 238 through which a pin 240 slideably extends. The pin extends from a plunger 242 which, in response to rocking movement of the lever about its pivot during the time that the follower 212 rides on the cam surface 210, withdraws the plunger from a recess 244 in the face of the drive sprocket 48 to free the drive sprocket for rotation. (FIGS. 5 & 6)

When the follower 212 clears the cam surface 210, the lever 231 is released to enable means constantly urging the plunger in the direction to engage the sprocket 48 whereupon the plunger enters an aligned recess 244 to lock the conveyor sprocket and the conveyor against movement. In the illustrated modification (FIG. 6), the means resiliently urging the plunger in the direction to become seated within one of a number of recesses 244 in the sprocket 48 comprises a compression spring 246 confined within a cavity 248 of block 236 with the free end of the compression spring extending into engagement with the end of the plunger 242 away from the sprocket.

In the past, it has been difficult to obtain a tightly tied bundle. This is believed to be caused by the interference from the means for stripping the twine from the knot whereby it becomes necessary to locate the knotter some distance from the bundle. This is believed to result from the fact that in bundle tying mechanisms heretofore produced, use had been made of strippers which move in the vertical direction.

It has been found, in accordance with the features of this invention, that a tightly bound bundle can be secured by modification of the stripper mechanism for movement of the stripper in a horizontal direction so that the stripper can be located with the tying and cutting mechanism closely adjacent the bottom side of the bundle being tied. In accordance with the practice of this invention, a stripper means is provided which moves in a plane parallel with the bottom side of the bundle between obstructing position and stripping position to enable the knotting head to rotate to effect the tie when the stripper is in unobstructed position and to strip the twine from the beak of the knotter upon movement to stripping position.

Figure 14:
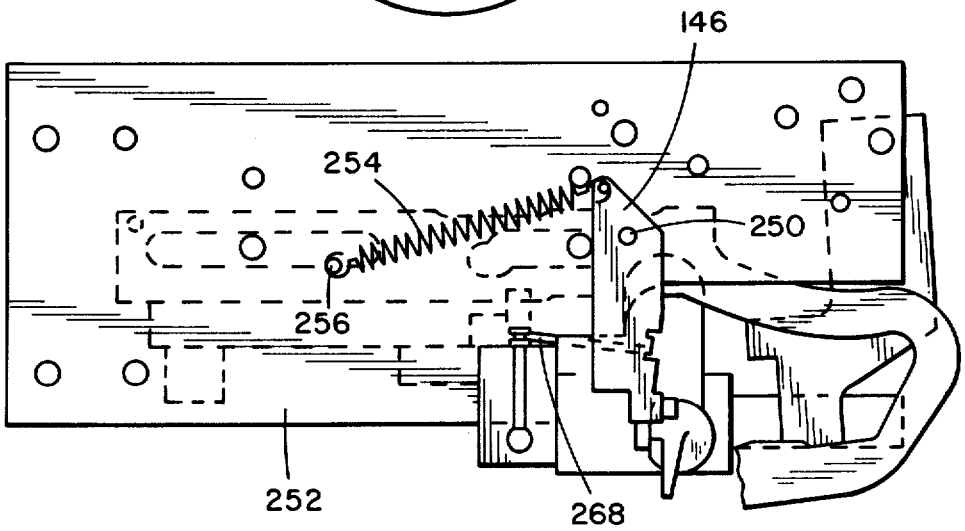
FIG. 14 is a top plan view of the stripper mechanism shown in FIG. 13.

FIG. 14 shows the stripper plate 146 in stripping position. The stripper plate 146 is pivoted for rocking movement about a pivot pin 250 fixed to the tying table 252. The stripper plate is constantly urged for rocking movement about one pivot by means of a tension spring 254 anchored at one end to a portion of the stripper plate offset from the pivot, while the other end is fixed onto a stud 256 fixed to a spaced portion of the tying table. Responsive to spring tension, a portion of the stripper plate 146 is urged into engagement with the beak or knotter head to strip the twine from the head as the head rocks away during the final stages of its operation.

The stripper plate is adapted positively to be displaced from stripping to unobstructed position in response to movement of a knotting cam 258 mounted for rotational movement with the main drive shaft 20. The stripper cam has a cam surface 260 adapted to be engaged by a stripper actuating lever 262 having a finger which rides on the cam surface. As the finger rides up on the cam surface 260, it raises the lever 262 which is engaged by rocker arm 264 to which an end of an L-shaped rod 266 is fixed for rocking movement about its pivot at the elbow. A spaced end portion of the other arm of the L-shaped rod is connected by link 268 to the stripper for withdrawal of the stripper plate from stripping position. Movement of the finger off of the cam surface frees the stripper plate for return by the tension spring 254 from unobstructed to stripping position.

In operation, the longitudinally spaced apart pairs of plates 60–62 are carried by the conveyor chains through the loading section. As the chains travel over the concave section of the guide rails, the spaced relation between the plates in the pair increases to provide an enlarged entrant portion for loading the bundle material or the like between the plates for subsequent bundling.

As the conveyor chain enters the bundle tying section were the chain links are confined for travel in a straight line, the spaced relation between the plates 60–62 in the pair are automatically reduced to a minimum firmly to grip the bundle therebetween.

As the conveyor continues in its unidirectional movement, the conveyor carries the plates 60–62 through the tying section. The presence of a bundle is indicated by engagement to trip the lever 160, which releases the needle shaft 132 for rotation in response to coil spring 148, under the control of the cam 174, for rocking movement of the needles 136–138 from raised to lowered position. This operates to wrap the twines in a dual function about the opposite lateral edge portions of the bundle in the area immediately alongside the plates. While the tying and cutting mechanism is operated, the conveyor is stopped as previously described. The stopping operation occurs automatically even in the absence of a signal indicating that a bundle is present between the plates.

Upon completion of the tying operation, and upon reengagement of the clutch with the drive sprocket, the conveyor chain continues in its forward movement with the tied bundle between the plates of the pair.

As shown in FIG. 1 of the drawing, the laterally spaced guide rails for the conveyor chains turn sharply downwardly along a concave curvature at the delivery station. This operates automatically to increase the spaced relation between the plates in the pair to release the tied bundle for removal by gravity or otherwise from the conveyor.

It will be apparent that the machine is fully automated with mechanical controls and operation thereby to provide for rapid bundling with substantially automatic feed of the material to be bundled and automatic delivery of the tied bundle.

It will be understood that changes may be made in the construction, arrangement and operation without departing from the spirit of the invention, especially as described in the following claims.

I claim:

1. In a bundle tying machine having in sequence a loading zone and a bundle tying zone, and an endless conveyor which travels through said loading zone and bundle tying zone, a plurality of longitudinally spaced apart pairs of longitudinally spaced plates carried by the conveyor in outwardly spaced apart relation from the conveyor, means for guiding the conveyor for travel along a concave curvilinear path during passage through the loading zone and along a straight horizontal path during travel through the bundle tying zone whereby the plates in the pair extend angularly in the direction away from each other to provide increased spaced relation therebetween while travelling with the conveyor through the loading zone and a minimum spaced relation therebetween during travel with the conveyor through the bundle tying zone, stationary support means in substantially parallel relation with the conveyor spaced outwardly of the conveyor but inwardly of the plates for support of the material inserted between the plates whereby the material is easily inserted between the plates during travel through the loading zone and compressed between the plates during subsequent travel through the bundle tying zone.

2. A bundle tying machine as claimed in claim 1 in which the conveyor comprises a laterally spaced apart pair of endless chains.

3. A bundle tying machine as claimed in claim 1 in which the plates in the pair extend perpendicularly outwardly from the conveyor.

4. A bundle tying machine as claimed in claim 1 in which the plates of the pairs are spaced apart by an amount corresponding to the approximate thickness of the bundle to be tied.

5. A bundle tying machine as claimed in claim 1 in which the plates of the pairs are dimensioned to have a width less than the width of the bundle to be tied so that the lateral end portions of the bundle will extend beyond the lateral edges of the plates.

6. A bundle tying machine as claimed in claim 1 in which the support means comprises a pair of laterally spaced apart, horizontally disposed platforms which extend endlessly through the loading section and are spaced one from the other by an amount greater than the width of the plates.

7. In a bundle tying machine, an endless conveyor, longitudinally spaced apart pairs of swing plates carried by the conveyor with the swing plates in each pair longitudinally spaced one from the other for receiving material to be tied into bundles therebetween, means mounting at least one of the swing plates in the pair for swinging movement relative to the other about a horizontally disposed axis extending crosswise of the plate comprising a base plate fixed to the conveyor, a pair of laterally spaced apart, interconnected bucket plates pivotally secured to the base plate for rocking movement relative thereto about a horizontal axis, means constantly urging the bucket plates for rocking movement in a direction towards the base plate, the swing plate extending crosswise of the bucket plates and means intermediate the upper and lower edges of the swing plate for pivotally mounting the swing plate for rocking movement relative to the bucket plates about a horizontal axis, and means resiliently urging the swing plate to rock in the direction to displace the upper portion of the swing plate towards the other plate in the pair.

8. A bundle tying machine as claimed in claim 7 in which the means constantly urging the bucket plates for rocking movement in the direction towards the base plate comprises spring means.

9. A bundle tying machine as claimed in claim 7 in which the means resiliently urging the upper portion of the swing plate to rock in the direction towards the other plate in the pair comprises spring means.

10. A bundle tying machine as claimed in claim 7 which includes means for limiting the extent of pivotal movement of the bucket plates in the direction away from the base plate.

11. A bundle tying machine as claimed in claim 7 which includes means for limiting the extent of pivotal movement of the swing plate in the direction towards the other plate in the pair.

12. A bundle tying machine as claimed in claim 7 in which one plate in the pair is mounted for swinging movement while the other plate in the pair is rigid with the conveyor.

13. A bundle tying machine as claimed in claim 7 in which the conveyor is a chain link conveyor and the base plate is secured to a length of the chain.

14. In a bundle tying machine, an endless conveyor comprising a pair of endless interconnected conveyor chains formed of chain links pivotally connected in end to end relation, driving means for guiding the conveyor chain along an upper run travelling sequentially through a loading section, a bundle tying section and a delivery section, a plurality of longitudinally spaced apart pairs of longitudinally spaced plates carried by and extending outwardly from the lengths of the chains, guide means operatively engaged by the upper run of the conveyor chains for guiding the chains in concave paths during their travel through the loading section and the unloading section whereby the plates in the pairs automatically become angularly disposed relative to each other to increase the spaced relation between the plates in the pairs in the upwardly direction during travel through the loading section and the unloading section and stationary guide means extending horizontally in a straight line through the bundle tying section, and operatively engaged by the conveyor chain during travel through the bundle tying section whereby the plates in the pair extend upwardly substantially perpendicularly from the conveyor chain in substantially parallel relation with a minimum of space in between.

15. A bundle tying machine as claimed in claim 14 in which the guide means in the tying section comprises upper and lower guide rails spaced vertically one from the other by an amount corresponding to the chain to confine the path therebetween during displacement through the tying section thereby to minimize flexing of the chains.

16. In a bundle tying machine as claimed in claim 14 which includes support means comprising a pair of laterally spaced apart platforms in substantially parallel relation with the guide rails but spaced above the guide rails for support of the bundle between the plates during movement through the loading section, the tying section and the delivery section.

17. A bundle tying machine as claimed in claim 14 which includes means for stopping the conveyor each time that a pair of plates arrives at a predetermined tying position in the tying section.

18. A bundle tying machine as claimed in claim 17 in which the means for stopping the conveyor each time a pair of plates arrives at a predetermined tying position in the bundle tying section with material between the plates to be tied comprises a drive shaft operatively connected to the conveyor, an intermittent motion clutch fixed on the drive shaft for rotational movement therewith, a chain sprocket mounted for rotational movement on the drive shaft alongside the clutch, and means mounted for movement between engagement and disengagement between the sprocket and clutch responsive to the presence of material to be tied into a bundle between the plates.

19. In a bundle tying machine, an endless conveyor comprising a pair of endless interconnected conveyor chains formed of chain links pivotally connected in end to end relation, means for guiding the conveyor chains along an upper run travelling sequentially through a loading section, a bundle tying section, and a delivery section, a plurality of longitudinally spaced apart pairs of longitudinally spaced plates carried by and extending outwardly from the links of the chains, guide means in the tying section operatively engaged by the upper run of the conveyor chains, said guide means extending horizontally in a straight line whereby the plates in the pair extend in substantially parallel relation with a minimum of space in between, tying means including one or more laterally spaced apart needles mounted for rocking movement between raised position above the upper edge of the plates and lowered position below the lower edge of the plates, means for supplying twine to the needles, means constantly urging the needles in the direction towards lowered position, means for releasably latching the needles in raised position, and means responsive to the presence of a bundle between the plates for releasing the latching means to free the needles for rocking movement from raised to lowered positions.

20. A bundle tying machine as claimed in claim 19 which includes means for supplying twine to the needles in which the means for supplying twine to the needles comprises spindles on which balls of twine are mounted for free movement.

21. A bundle tying machine as claimed in claim 19 in which the means constantly urging the needles to lowered position comprises a needle shaft mounted for free rotational movement, a coil spring encircling the shaft with one end anchored to the shaft while the other end is fixed and in which the needles extend from axially spaced portions of the shaft.

22. A bundle tying machine as claimed in claim 19 in which the means responsive to the presence of a bundle between the plates for release of the latch comprises a trip lever mounted for rocking movement between normal position and operated position which, when in normal position extends upwardly into the path of a bundle when carried between the plates into the tying section, and which when engaged by the bundle between the plates, is tripped to operated position, and means for releasing the latch responsive to movement of the trip level from normal to operated position.

23. A bundle tying machine as claimed in claim 19 in which the tying means comprises a pair of needles laterally spaced apart by an amount greater than the spaced relation between the conveyor chains.

24. In a bundle tying machine an endless conveyor, means for guiding the conveyor to travel sequentially through a loading section, a bundle tying section and a delivery section, tying means including one or more needles mounted for rocking movement between raised position, out of the path of the bundle in the tying section, and a lowered position below the bottom side of the bundle in the tying section, and means for supplying twine to the needles, means for imposing slight tension on the twine during movement of the needles from raised to lowered position, and means for increasing the tension on the twine upon movement of the needles to lowered position and during the bundle tying operation comprising a pair of leaf springs one of which is of greater compression than the other, and means mounting the leaf springs with the free ends normally in engagement with the twine, means operative to engage the leaf spring of greater compression to disengage the leaf spring from the twine while the needles rock from raised to lowered positions and for release of the leaf spring of greater compression for reengagement with the twine while the needles are in lowered position and during the tying and cutoff operation.

25. A bundle tying machine as claimed in claim 24 which includes a main drive, a cam means on the main drive, and means operatively engaging the cam means and connected to the means

26. In a bundle tying machine which makes use of a bundle tying and cutoff mechanism for engaging twine wrapped around a bundle to tie the twine about the bundle and to cut the twine upon completion of the tying operation, in which the tying mechanism is provided with a beak which engages the twine below the bundle for the twisting and tying operation, the improvement which makes use of a stripper for removal of the twine from the tying mechanism in which the stripper comprises a flat stripper plate mounted for rocking movement about an axis perpendicular to the plane formed by the bottom side of the bundle and in a plane parallel with and immediately adjacent the bottom side of the bundle, said stripper plate being operative between normal position for stripping the twine and retracted position out of the path of the tying mechanism, means resiliently urging the stripper plate towards normal position and means for displacement of the stripper plate to retracted position to clear the space for the tying mechanism.

27. In a bundle tying machine an endless conveyor, means for guiding the conveyor to travel sequentially through a loading section, a bundle tying section and a delivery section, tying means including one or more needles mounted for rocking movement between raised position, out of the path of the bundle in the tying section, and a lowered position below the bottom side of the bundle in the tying section, and means for supplying twine to the needles, means for imposing slight tension on the twine during movement of the needles from raised to lowered position, and means for increasing the tension on the twine upon movement of the needles to lowered position and during the bundle tying operation and a retainer member in the path to be engaged by the twine during initial movement of the needles from lowered position to raised position thereby to prevent release of the twine from a position for use in a next cycle of operation.

28. A bundle tying machine as claimed in claim 27 which includes a twine holder about which the twine is wrapped in response to movement of the needle from lowered to raised position.

29. In a bundle tying machine, a loading zone, a bundle tying zone, and an unloading zone, an endless conveyor the upper run of which travels in sequence through the loading zone, bundle tying zone and unloading zone, a plurality of longitudinally spaced apart pairs of longitudinally spaced apart plates carried by the conveyor, means for guiding the conveyor along a concave curvilinear path during travel of the upper run through the loading zone, whereby, during travel along said concave curvilinear path, the plates in the pair are automatically displaced in the direction away from each other with an increasing spaced relation therebetween from the bottom to the top of the plates, providing an entrant portion to enable downward insertion of material to be bundled to between the plates.

30. A bundle tying machine as claimed in claim 29 in which the concave curvilinear path has a radius within the range of 24–96 inches.

* * * * *